US007661605B2

(12) United States Patent
Shieh

(10) Patent No.: US 7,661,605 B2
(45) Date of Patent: Feb. 16, 2010

(54) FIXING STRUCTURE FOR A VERTICAL TAP

(75) Inventor: Ming-Dang Shieh, Chang Hua Hsien (TW)

(73) Assignee: Horng Lai Industrial Co., Ltd., Chang Hua Hsien (TW)

( * ) Notice: Subject to any disclaimer, the term of this patent is extended or adjusted under 35 U.S.C. 154(b) by 62 days.

(21) Appl. No.: 11/970,648

(22) Filed: Jan. 8, 2008

(65) Prior Publication Data

US 2009/0172878 A1 Jul. 9, 2009

(51) Int. Cl.
*B05B 15/06* (2006.01)

(52) U.S. Cl. ..... 239/200; 239/600; 4/678; 4/695; 137/360; 137/801

(58) Field of Classification Search ..... 239/200; 4/677, 678, 695; 137/359, 360, 801
See application file for complete search history.

(56) References Cited

U.S. PATENT DOCUMENTS 4,553,277 A * 11/1985 Duncan ..... 4/643
6,301,728 B1 * 10/2001 Pilatowicz et al. ..... 4/695
6,434,765 B1 * 8/2002 Burns et al. ..... 4/676
6,792,629 B2 * 9/2004 Nelson et al. ..... 4/695

* cited by examiner

*Primary Examiner*—Dinh Q Nguyen
(74) *Attorney, Agent, or Firm*—Alan Kamrath; Kamrath & Associates PA

(57) ABSTRACT

A fixing structure for a vertical tap includes a vertical tap, a mounting member, a fitting member, a fixing ring, and a decorative loop. The mounting member secured in the ground includes a receiving chamber arranged on the top thereof and has two retaining tabs aft ached on the upper end thereof. The upper end of the fitting member screws with the lower end of the vertical tap. The fitting member includes two opposite fastening projections disposed on the outer periphery at the lower end thereof and extending outwardly therefrom. The fixing ring is fitted onto the external rim of the vertical tap, is then secured in a wooden floor by using a number of wood screws, and is further engaged with the internal rim of the vertical tap by way of a bolt. The decorative loop covers the fixing ring, thereby supporting and securing the vertical tap easily.

20 Claims, 5 Drawing Sheets

FIXING STRUCTURE FOR A VERTICAL TAP

BACKGROUND OF THE INVENTION

1. Field of the Invention

The present invention relates to a fixing structure and, more particularly, to a fixing structure for a vertical tap that may effectively and easily secure the vertical tap.

2. Description of the Prior Arts

As shown in FIGS. 1 and 2, a conventional fixing structure for a vertical tap includes a vertical tap 10, the bottom of which is directly affixed to a wooden floor A by using a screwing seat 20. In assembly, external threads 201 of the screwing seat 20 are screwed with internal threads 101 of the bottom of the vertical tap 10, and a plurality of wood screws 30 are inserted through a number of predetermined through holes 202 of the screwing seat 20. Thus, the vertical tap 10 may be locked in the wooden floor A.

Nevertheless, such a conventional fixing structure may have a disengagement of the vertical tap 10 from the wooden floor A, because the vertical tap 10 is simply screwed with the screwing seat 20 together. Furthermore, in order to align an outlet pipe of the vertical tap 10 with the bathtub, the vertical tap 10 has to be further fixed by virtue of the wood screws 30 after being positioned, causing an inconvenient assembly.

The present invention has arisen to mitigate and/or obviate the afore-described disadvantages.

SUMMARY OF THE INVENTION

The primary object of the present invention is to provide a fixing structure for a vertical tap. The lower end of the vertical tap is directly secured to the ground by way of the mounting member and the fitting member, and the fitting ring and the bolt may be auxiliary used to support and retain the vertical tap, thus obtaining a double engagement.

Another object of the present invention is to provide a fixing structure for a vertical tap, where the lower end of the vertical tap is directly secured to the ground by way of the mounting member and the fitting member so that the vertical tap may automatically align with the bathtub. Then, the screwed holes of the fixing ring may be utilized to screw the bolt and the vertical tap together, thereby engageably securing the vertical tap.

In accordance with one aspect of the present invention, there is provided a fixing structure for a vertical tap comprising a vertical tap, a mounting member, a fitting member, a fixing ring, and a decorative loop. The mounting member for securement into the ground includes a receiving chamber arranged on the top thereof and has two retaining tabs attached on the upper end thereof. The upper end of the fitting member screws with the lower end of the vertical tap, and the fitting member includes two opposite fastening projections disposed on the outer periphery at the lower end thereof and extending outwardly therefrom. The fixing ring is fitted onto the external rim of the vertical tap, is then secured in a wooden floor by using a number of wood screws and is further engaged with the internal rim of the vertical tap by way of a bolt. The decorative loop covers the fixing ring, thereby supporting and securing the vertical tap easily.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
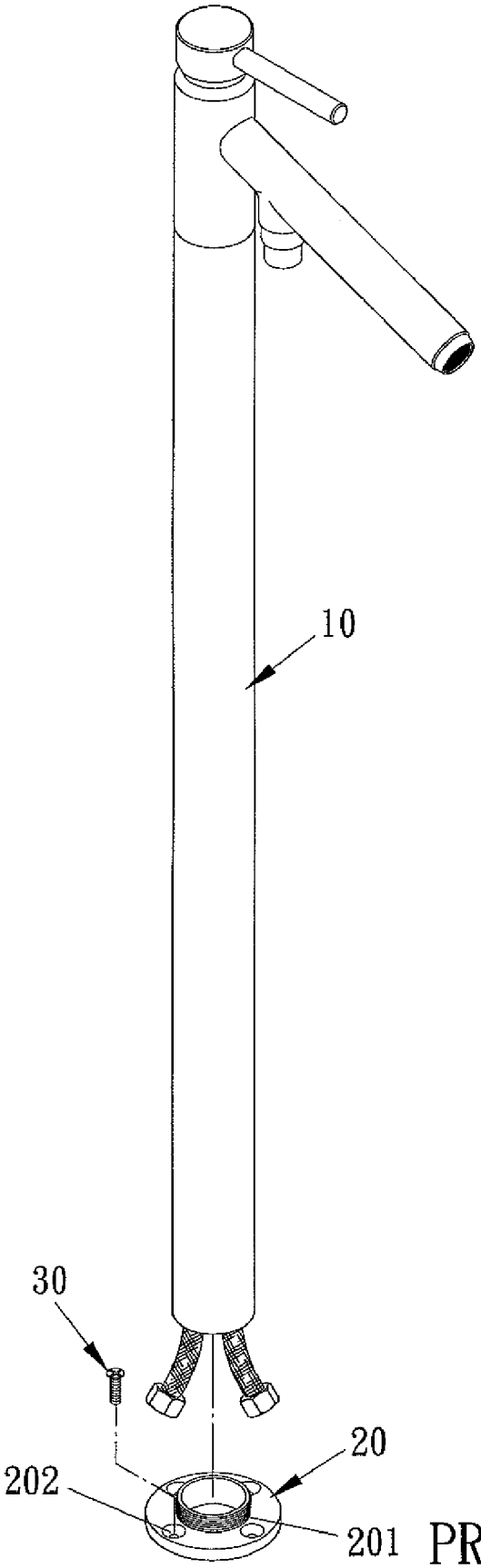
FIG. 1 PRIOR ART
FIG. 1 is a perspective diagram illustrating the exploded components of a conventional fixing structure for a vertical tap.
Figure 2:
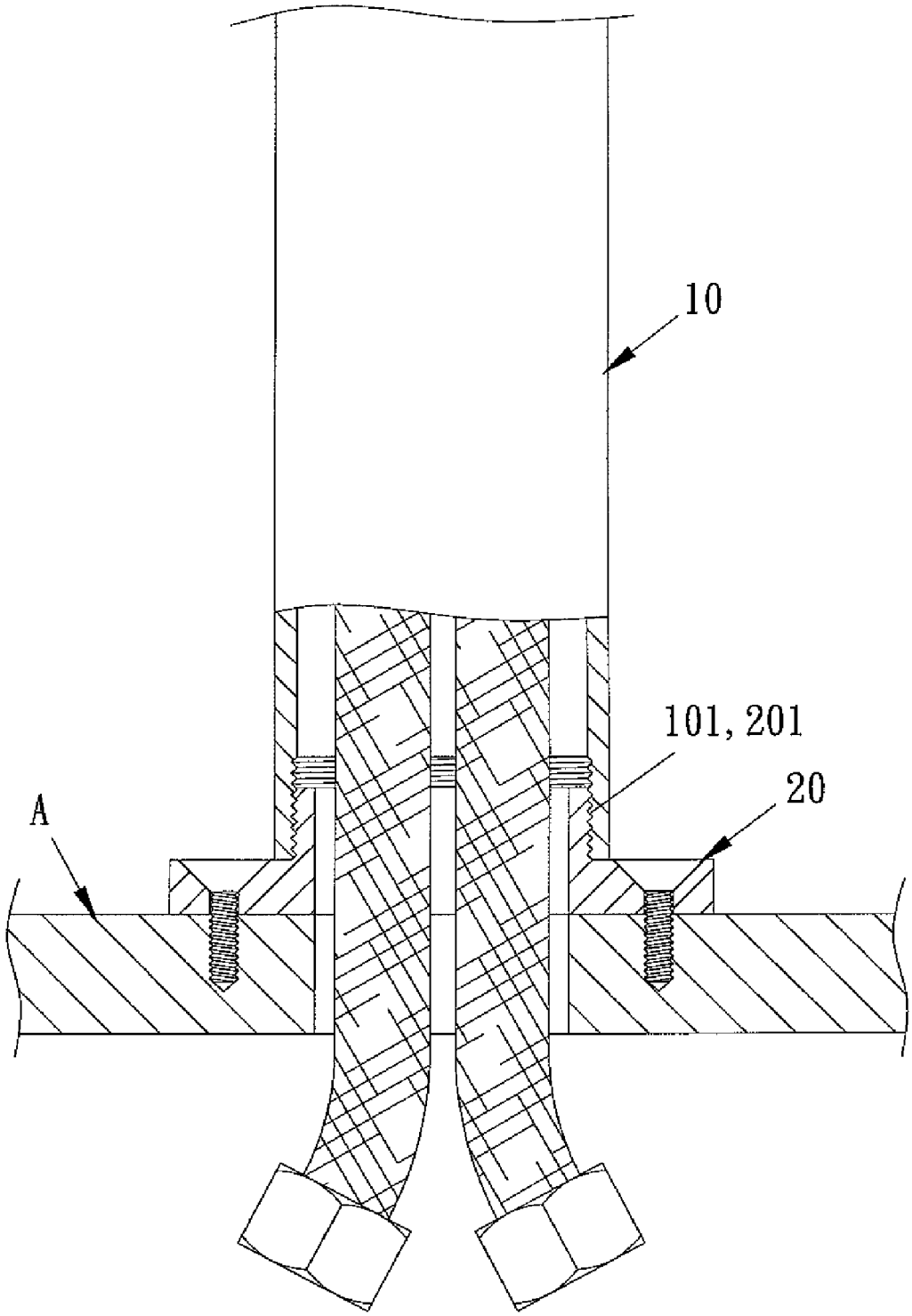
FIG. 2 PRIOR ART
FIG. 2 is a cross sectional diagram illustrating the conventional fixing structure for the vertical tap secured in the ground.
Figure 3:
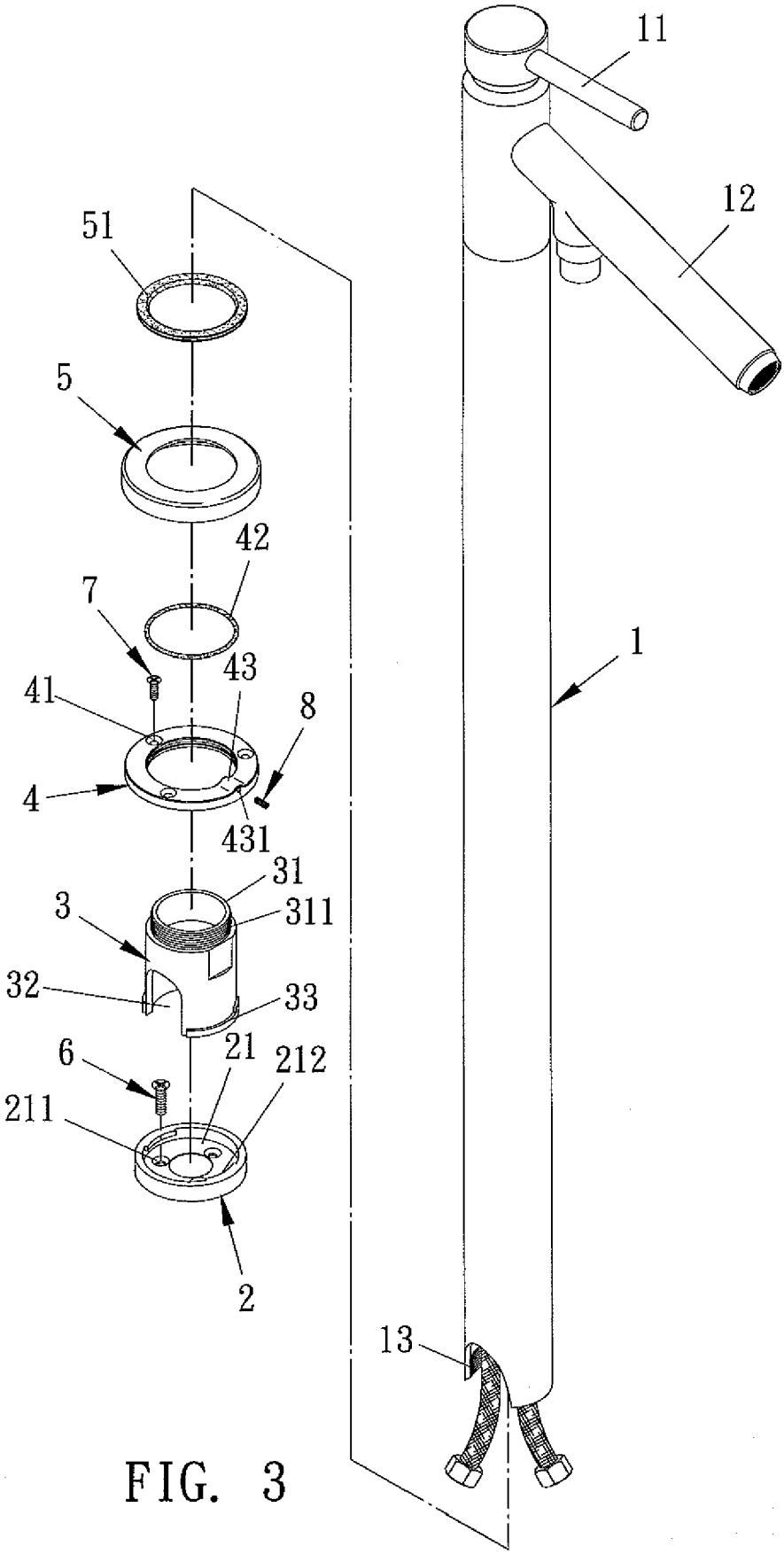
FIG. 3 is a perspective diagram illustrating the exploded components of a fixing structure for a vertical tap according to the present invention.
Figure 4:
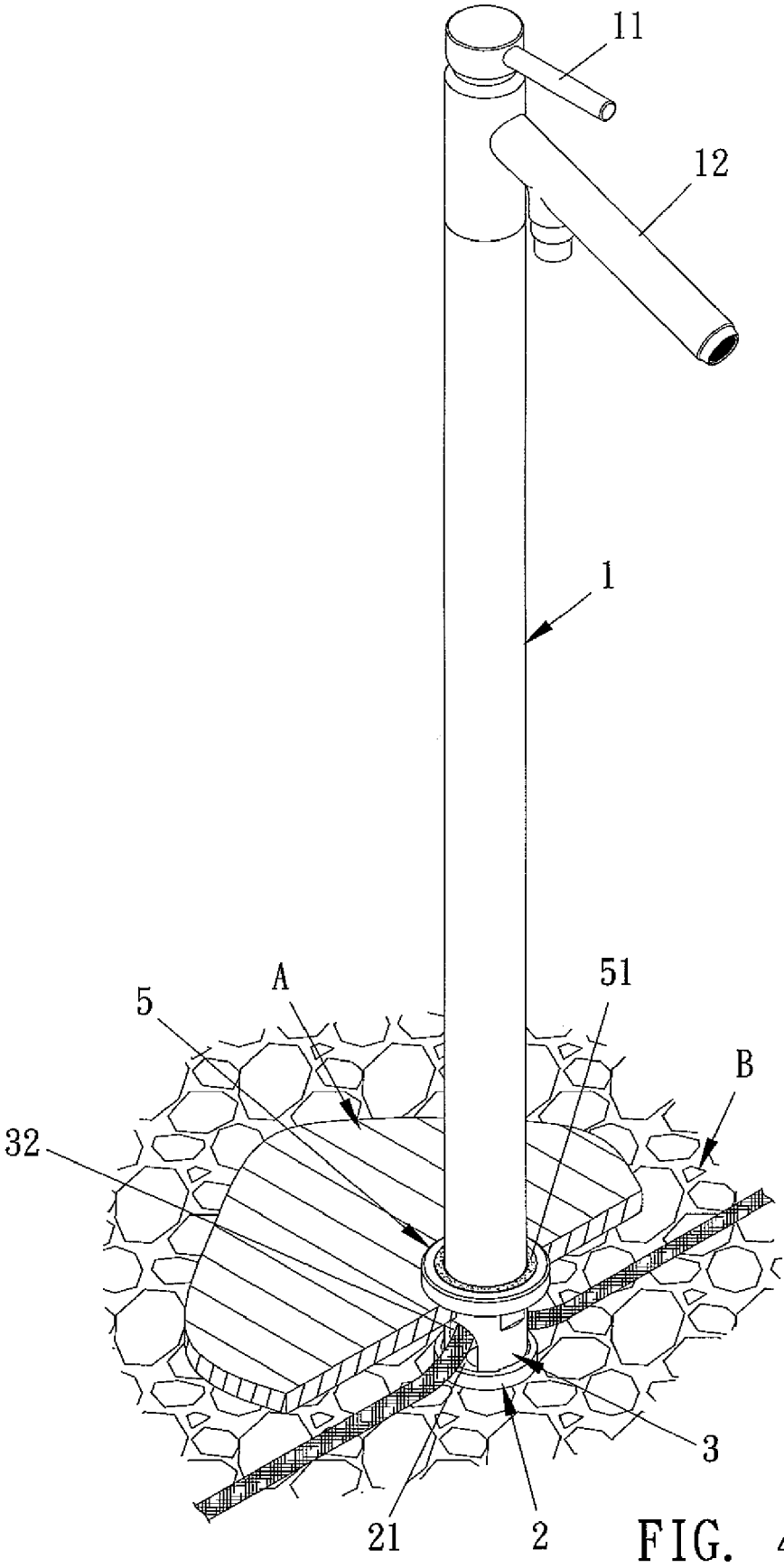
FIG. 4 is a perspective diagram illustrating the fixing structure for the vertical tap secured in the ground.
Figure 5:
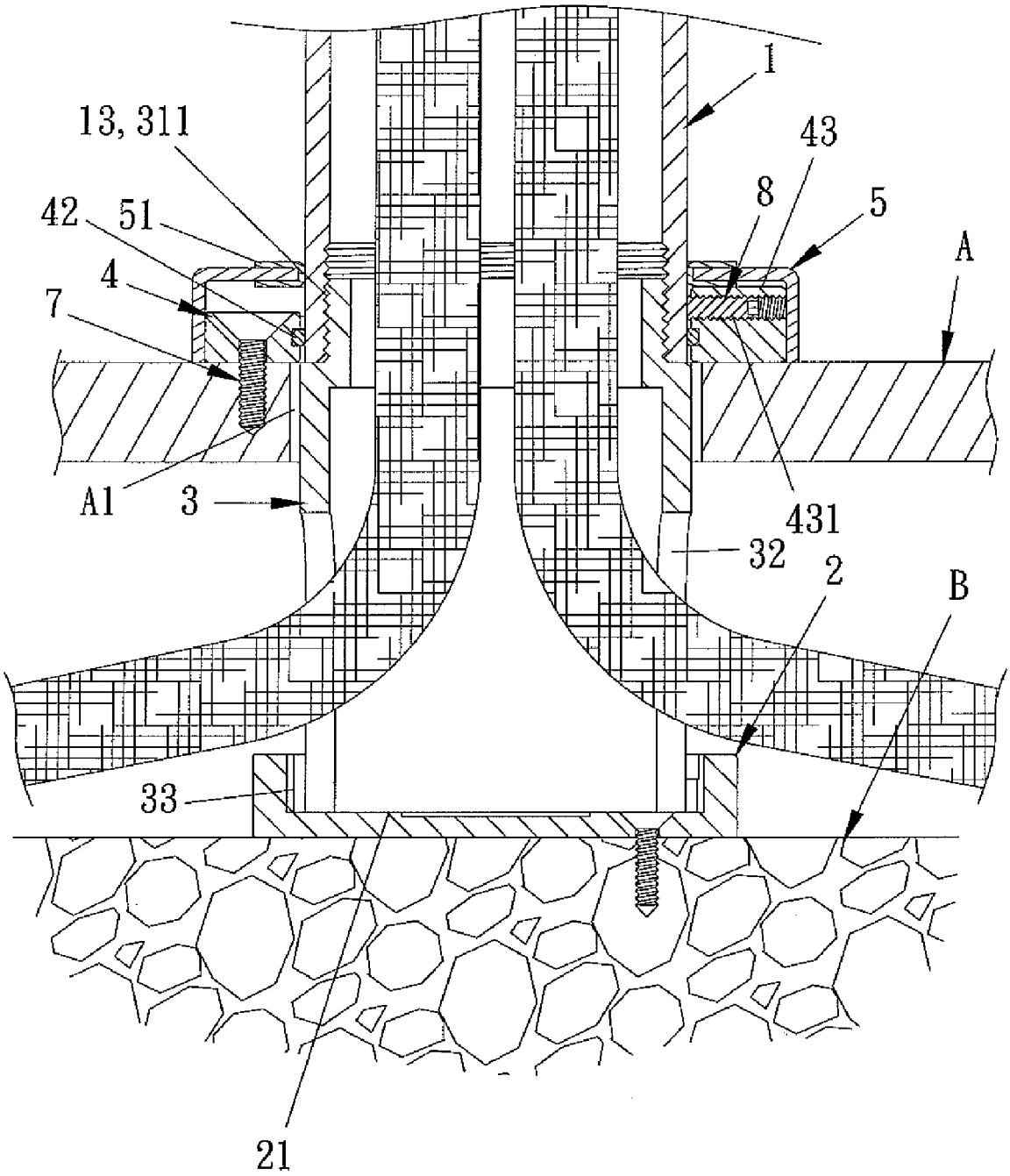
FIG. 5 is a cross sectional diagram illustrating the fixing structure for the vertical tap secured in the ground.

Referring to FIGS. 3-5, a fixing structure for a vertical tap in accordance with the present invention comprises a vertical tap 1, a mounting member 2, a fitting member 3, a fixing ring 4, and a decorative loop 5. The vertical tap 1 includes a control lever 11 and an outlet pipe 12, both of which are disposed thereon. The vertical tap 1 further includes internal threads 13 formed on the inner sidewall at the lower end thereof. The mounting member 2 is constructed in the form of a disc and includes a circular receiving chamber 21 arranged on the top thereof. The bottom of the circular receiving chamber 21 is provided with three locking holes 211. On the upper end of the receiving chamber 21 are attached two retaining tabs 212 positioned relative to each other. The lifting member 3 includes a size variable segment 31 with external threads 311 affixed on the upper end thereof. The fitting member 3 further includes two opposite gaps 32 for inserting cold and hot water supply tubes therein respectively. The fitting member 3 also includes two opposite fastening projections 33 disposed on the outer periphery at the lower end thereof, with the fastening projections 33 extending outwardly therefrom and each having two stepped portions formed thereon. The fixing ring 4 includes three locking holes 41 mounted thereon, an O-ring 42 attached to the inner rim thereof, and a raised portion 43 arranged on the top surface thereof. A horizontal screwed hole 431 passes through the raised portion 43. The decorative loop 5 is constructed in the shape of a circle and includes a rubber washer 51 filled in the inner wall thereof.

In assembly, a predetermined position of a wooden floor A is provided with an engaging bore A1 so that the mounting member 2 may be correspondingly secured in the ground B under the engaging bore A1. A plurality of screws 6 may be inserted through the three locking holes 211 of the mounting member 2 to be threadably engaged. Thereafter, the decorative loop 5 and the fixing ring 4 are fitted onto the external rim of the vertical tap 1 in turn. Then, the lifting member 3 is assembled to the vertical tap 1 by screwing its external threads 311 with the internal threads 13 of the vertical tap 1. Thus, the fining member 3 passes through the engaging bore A1 of the wooden floor A to be rotatably inserted into the receiving chamber 21 of the mounting member 2. Hence, the lower of two stepped portions of the two fastening projections 33 matingly engage with the bottom sides of the two retaining tabs 212 of the mounting member 2, easily affixing the fitting member 3 to the mounting member 2. Further, the vertical tap 1 is aligned with a bathtub, and the fixing ring 4 is moved downwardly to abut against the wooden floor A on the basis of the predetermined height of the wooden floor A, thereby generating a distance between the mounting member 2 and the fixing member 4. Then, a number of wood screws 7 are inserted through the locking holes 41 of the fixing ring 4 for securing the fixing member 4 in the wooden floor A. A bolt 8 is provided to screw into the screwed hole 431 of the fixing member 4 for being further engaged with the internal rim of the vertical tap 1, thus reinforcing the engagement of the vertical tap 1. Finally, the decorative loop 5 is covered downwardly on the fixing ring 4, enhancing the aesthetics appearance.

It can be clearly seen from the preceding accounts on the features of the present invention that the fixing structure for the vertical tap 1 of the present invention has the following advantages:

1. The lower end of the vertical tap 1 is directly secured in the ground B by way of the mounting member 2 and the fitting member 3, and the fitting ring 4 and the bolt 8 may be auxiliary used to support and engage the vertical tap 1, thus obtaining a double engagement.

2. In assembly, the lower end of the vertical tap 1 is directly secured in the ground by way of the mounting member 2 and the fining member 3 so that the vertical tap 1 may automatically align with the bathtub. Then, the screwed holes 431 of the fixing ring 4 may be utilized to screw the bolt 8 and the vertical tap 1 together, thereby engageably securing the vertical tap 1.

The invention is not limited to the above embodiment but various modifications thereof may be made. It will be understood by those skilled in the art that various changes in form and detail may be made without departing from the scope and spirit of the present invention.

What is claimed is:

1. A fixing structure for a vertical tap comprising:

a vertical tap having a lower end, an internal rim and an external rim;

a mounting member adapted to be secured in ground and including a receiving chamber arranged on a top thereof;

a fitting member having an upper end assembled to the lower end of said vertical tap, wherein the fitting member passes through an engaging bore of a wooden floor and rotatably inserted into said receiving chamber of said mounting member; and a fixing ring fitted onto the external rim of said vertical tap and secured in the wooden floor by wood screws, with the fixing ring further engaged with the internal rim of said vertical tap by a bolt, wherein on an upper end of said receiving chamber are attached two retaining tabs positioned relative to each other, and said fitting member includes two opposite fastening projections disposed on an outer periphery at a lower end thereof and matingly engaging with bottom sides of said two retaining tabs of said mounting member.

2. The fixing structure for the vertical tap as claimed in claim 1, wherein at a bottom of said receiving chamber of said mounting member are three locking holes.

3. The fixing structure for the vertical tap as claimed in claim 1, wherein each of said two opposite fastening projections has two stepped portions formed thereon.

4. The fixing structure for the vertical tap as claimed in claim 1, wherein said fitting member includes a size variable segment with external threads affixed on the upper end thereof for screwing with internal threads formed on an inner sidewall at the lower end of said vertical tap.

5. A fixing structure for a vertical tap comprising:

a vertical tap having a lower end, an internal rim and an external rim;

a mounting member adapted to be secured in ground and including a receiving chamber arranged on a top thereof;

a fitting member having an upper end assembled to the lower end of said vertical tap, wherein the fitting member passes through an engaging bore of a wooden floor and rotatably inserted into said receiving chamber of said mounting member; and a fixing ring fitted onto the external rim of said vertical tap and secured in the wooden floor by wood screws, with the fixing ring further engaged with the internal rim of said vertical tap by a bolt, wherein said fitting member includes two opposite gaps secured on the lower end thereof.

6. The fixing structure for the vertical tap as claimed in claim 5, wherein said fixing ring includes a plurality of locking holes mounted thereon.

7. The fixing structure for the vertical tap as claimed in claim 5, wherein said fixing ring includes an O-ring attached to an inner rim thereof.

8. A fixing structure for a vertical tap comprising:

a vertical tap having a lower end, an internal rim and an external rim;

a mounting member adapted to be secured in round and including a receiving chamber arranged on a top thereof;

a fitting member having an upper end assembled to the lower end of said vertical tap, wherein the fitting member passes through an engaging bore of a wooden floor and rotatably inserted into said receiving chamber of said mounting member; and a fixing ring fitted onto the external rim of said vertical tap and secured in the wooden floor by wood screws, with the fixing ring further engaged with the internal rim of said vertical tap by a bolt, wherein said fixing ring includes a raised portion arranged on a top surface thereof, wherein a horizontal screwed hole passes through the raised portion.

9. The fixing structure for the vertical tap as claimed in claim 8, further comprising a decorative loop fitted to said vertical tap for further covering said fixing ring.

10. The fixing structure for the vertical tap as claimed in claim 9, wherein said decorative loop includes a rubber washer fitted in an inner wall thereof.

11. The fixing structure for the vertical tap as claimed in claim 8, wherein at a bottom of said receiving chamber of said mounting member are three locking holes.

12. The fixing structure for the vertical tap as claimed in claim 8, wherein said fitting member includes a size variable segment with external threads affixed on the upper end thereof for screwing with internal threads formed on an inner sidewall at the lower end of said vertical tap.

13. The fixing structure for the vertical tap as claimed in claim 8, wherein said fixing ring includes a plurality of locking holes mounted thereon.

14. The fixing structure for the vertical tap as claimed in claim 8, wherein said fixing ring includes an O-ring attached to an inner rim thereof.

15. The fixing structure for the vertical tap as claimed in claim 5, wherein at a bottom of said receiving chamber of said mounting member are three locking holes.

16. The fixing structure for the vertical tap as claimed in claim 5, wherein said fitting member includes a size variable segment with external threads affixed on the upper end thereof for screwing with internal threads formed on an inner sidewall at the lower end of said vertical tap.

17. The fixing structure for the vertical tap as claimed in claim 5, further comprising a decorative loop fitted to said vertical tap for further covering said fixing ring.

18. The fixing structure for the vertical tap as claimed in claim 17, wherein said decorative loop includes a rubber washer fitted in an inner wall thereof.

19. The fixing structure for the vertical tap as claimed in claim 1, wherein said fixing ring includes a plurality of locking holes mounted thereon.

20. The fixing structure for the vertical tap as claimed in claim 1, further comprising a decorative loop fitted to said vertical tap for further covering said fixing ring.

* * * * *